US006932891B2

(12) United States Patent
Wigg et al.

(10) Patent No.: US 6,932,891 B2
(45) Date of Patent: Aug. 23, 2005

(54) WEAR INDICATOR FOR SACRIFICIAL ANODE

(75) Inventors: Martin Wigg, North Wales, PA (US); Henry Leipert, East Norriton, PA (US); James Elder, Sellersville, PA (US); Kelvin P. Dixon, North Wales, PA (US)

(73) Assignee: Performance Metals, Inc., Bechtelsville, PA (US)

( * ) Notice: Subject to any disclaimer, the term of this patent is extended or adjusted under 35 U.S.C. 154(b) by 70 days.

(21) Appl. No.: 10/838,696

(22) Filed: May 4, 2004

(65) Prior Publication Data

US 2004/0222084 A1 Nov. 11, 2004

Related U.S. Application Data

(60) Provisional application No. 60/513,634, filed on Oct. 23, 2003, and provisional application No. 60/468,291, filed on May 6, 2003.

(51) Int. Cl.[7] ..... C23F 13/00

(52) U.S. Cl. ..... 204/196.06; 204/196.02; 204/196.21; 204/196.36; 204/196.37; 204/404; 204/280; 324/71.1; 324/71.2; 73/86

(58) Field of Search ..... 204/196.06, 196.02, 204/196.21, 196.36, 196.37, 404, 280; 324/71.1, 71.2; 73/86; 340/572.1; 342/42, 44, 51; 343/872, 873

(56) References Cited

U.S. PATENT DOCUMENTS

| | | | | | |
|---|---|---|---|---|---|
| 4,051,007 | A | * | 9/1977 | Hossle | 204/196.07 |
| 5,373,728 | A | * | 12/1994 | Guentzler | 204/196.07 |
| 5,627,414 | A | * | 5/1997 | Brown et al. | 205/726 |
| 6,100,804 | A | * | 8/2000 | Brady et al. | 340/572.7 |
| 6,131,443 | A | * | 10/2000 | Duncan | 73/86 |
| 6,279,617 | B1 | * | 8/2001 | Havn | 138/155 |
| 6,611,133 | B2 | * | 8/2003 | Kean et al. | 324/71.1 |

* cited by examiner

*Primary Examiner*—Bruce F. Bell
(74) *Attorney, Agent, or Firm*—Akin Gump Strauss Hauer & Feld, LLP

(57) ABSTRACT

An apparatus for indicating when a predetermined portion of a sacrificial anode has been corroded comprises a detector embedded within the interior of the sacrificial anode initially at a predetermined distance from an exposed exterior surface of the sacrificial anode. The detector detects the absence of sacrificial anode material when the predetermined portion has corroded and generates a detection signal. A monitoring system communicates with the detector for receiving detection signals and generates an indicator signal when a detection signal is received. An indicator in communication with the monitoring system receives indicator signals and generates an alarm when an indicator signal is received.

19 Claims, 7 Drawing Sheets

WEAR INDICATOR FOR SACRIFICIAL ANODE

CROSS-REFERENCE TO RELATED APPLICATIONS

This application claims the benefit of U.S. Provisional Patent Application No. 60/468,291 filed May 6, 2003, and entitled "Visual Wear Indicator for Sacrificial Anode, and U.S. Provisional Patent Application No. 60/513,634 filed Oct. 23, 2003 and entitled "Wear Indicator for Sacrificial Anode.

BACKGROUND OF THE INVENTION

The present invention relates generally to sacrificial anodes and, more particularly, to a wear indicator within a sacrificial anode for alerting a user when the sacrificial anode has corroded to the extent that it should be replaced.

Any metal in an electrolyte, such as salt water, generates an electrical voltage. When the electrolyte is in contact with another type of metal, electrons (electrical current) flow from a more negatively charged metal electrode or anode to a more positively charged metal electrode or cathode. The circuit is completed by the loss of positively charged ions from the anode into the electrolyte and the deposition of negatively charged ions from the electrolyte onto the cathode. This process results in corrosion or deterioration of the anodic metal material and the protection of the cathodic material.

In order to protect metals, particularly metals which could potentially serve as an anode, within an electrolyte (salt water), a third, more negatively charged metal is often secured to the metal to be protected. The third, more negatively charged metal corrodes "sacrificially" to protect the other two metals. The third more negatively charged metal is commonly referred to as a "sacrificial anode" and is typically made from an "active" metal such as zinc, magnesium, special aluminum alloys or other active metals.

While sacrificial anodes are very effective in protecting other metals, particularly the protected metal to which the sacrificial anode is secured, eventually a sacrificial anode wears out due to corrosion and its effectiveness in protecting the attached metal diminishes. Typically, in order to maintain effectiveness, the sacrificial anode must be replaced when the sacrificial anode has corroded to approximately one half of its original size. In order to know when a sacrificial anode has reached one half of its original size, it is usually necessary for a user to know the original size, a task which is often difficult. As a result, users typically replace sacrificial anodes before the useful life of the sacrificial anode has been exhausted, thereby wasting at least a portion of the useful life of the sacrificial anode. Alternatively, users wait too long to replace the sacrificial anode thereby potentially causing corrosion or deterioration of the protected metal. The present invention comprises an apparatus for eliminating such uncertainty by providing a user with a positive easily discernable indicator of when it is time to replace a sacrificial anode without undue risk to the protected metal and without undue waste of the sacrificial anode.

BRIEF SUMMARY OF THE INVENTION

Briefly stated, in one embodiment, the present invention comprises an apparatus for visually indicating when a predetermined portion of a sacrificial anode has been corroded. The apparatus is comprised of a first non-corroding wear indicator imbedded within the interior of the sacrificial anode at at least a first predetermined distance from an exposed exterior surface of the sacrificial anode so that the wear indicator is not visible when the sacrificial anode is initially installed on a metal to be protected. The wear indicator becomes exposed and visible only after a predetermined portion of the sacrificial anode has corroded.

In another embodiment, the present invention comprises an apparatus for indicating when a predetermined portion of a sacrificial anode has been corroded. The apparatus comprises a detector imbedded within the interior of the sacrificial anode initially at a predetermined distance from an exposed exterior surface of the sacrificial anode. The detector is for detecting the absence of sacrificial anode material when the predetermined portion has corroded and for generating a detection signal. A monitoring system in communication with the detector is provided for receiving detection signals and for generating an indicator signal when a detection signal is received. An indicator in communication with the monitoring system receives indicator signals and generates an alarm when an indicator signal is received.

In a further embodiment, the present invention comprises an apparatus for indicating when a predetermined portion of a sacrificial anode has been corroded. The apparatus comprises a radio frequency identification (RFID) device embedded within the interior of the sacrificial anode at a predetermined distance from an exposed exterior surface of the sacrificial anode. The presence of the RFID device is detectable by a detection system until the predetermined portion of the sacrificial anode has corroded whereupon the RFID device separates from the sacrificial anode and is no longer detectable.

BRIEF DESCRIPTION OF THE SEVERAL VIEWS OF THE DRAWINGS

The foregoing summary as well as the following detailed description of preferred embodiments of the invention will be better understood when read in conjunction with the appended drawings. For the purpose of illustrating the invention, there are shown in the drawings embodiments which are presently preferred. It should be understood, however, that the invention is not limited to the precise arrangements and instrumentalities shown.

In the drawings.

DETAILED DESCRIPTION OF THE INVENTION

Figure 1:
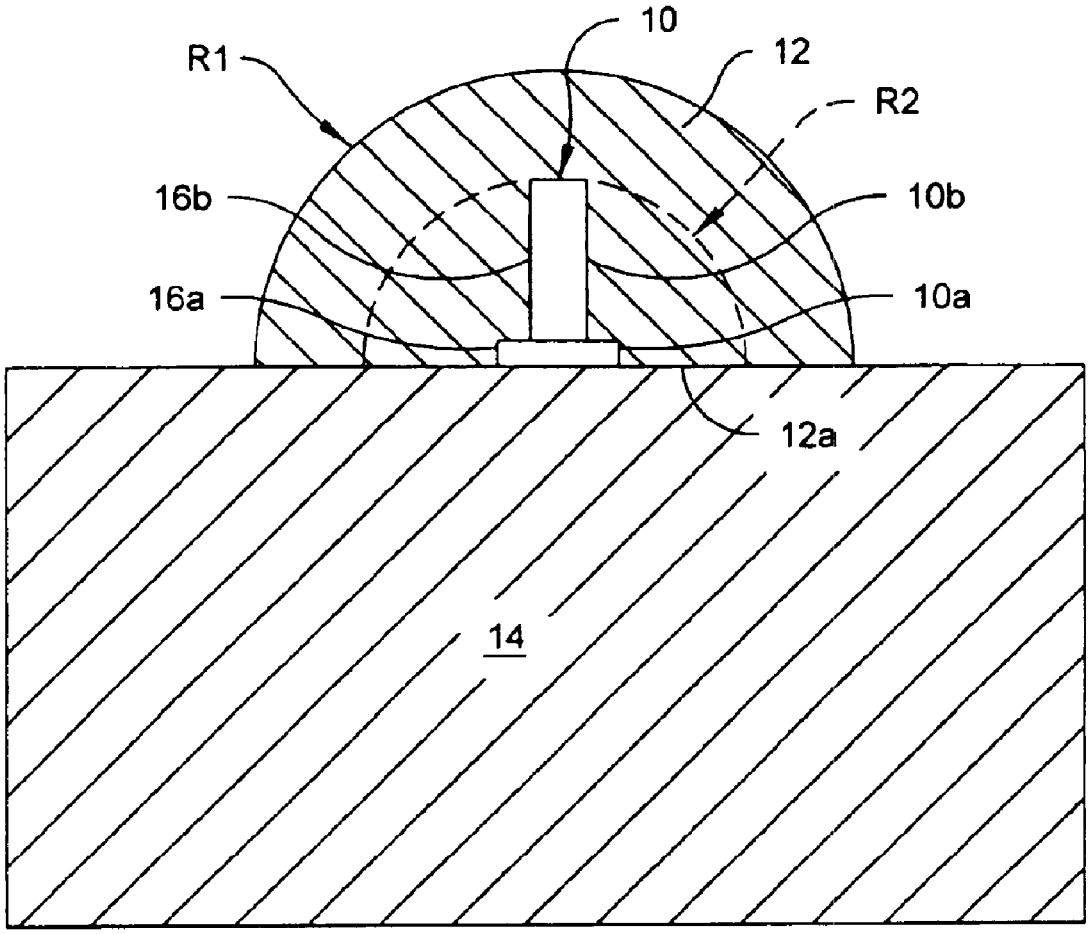
FIG. 1 is a sectional schematic block diagram of a sacrificial anode incorporating a visual wear indicator in accordance with a first preferred embodiment of the present invention.

The present invention comprises a wear indicator, which alerts a user when a sacrificial anode has corroded to the extent of its useful life and should be replaced. FIG. 1 illustrates a first preferred embodiment of a visual wear indicator 10 in accordance with the present invention. FIG. 1 is a sectional schematic representation of a sacrificial anode 12 including a visual wear indicator 10 embedded therein. As shown in the present embodiment, the sacrificial anode 12 is generally semicircular in cross section and is secured in a known manner along its generally flat rear surface 12*a* to a metal component 14 to be protected. It will be appreciated by those of ordinary skill in the art that while the sacrificial anode 12 in connection with the present embodiment is generally semicircular in cross section, the sacrificial anode 12 could be any other desired shape for a particular application.

The wear indicator 10 is preferably formed of a non-corroding material which does not interact with the sacrificial anode 12 or the protected metal 14 and is located or embedded within the interior of the sacrificial anode 12 as shown on FIG. 1. Preferably, the wear indicator 10 is made of a polymeric material, which, preferably, is of a bright, easily visible color such as day glow, red, yellow, etc. It will be appreciated by those of ordinary skill in the art that the wear indicator 10 may be made of other materials or could be made of some other color. As shown in FIG. 1, the wear indicator 10 is comprised of a generally disk-like cylindrical base portion 10*a* and a generally elongated cylindrical extension portion 10*b* having a diameter which is smaller than the diameter of the base portion 10*a*. The wear indicator 10 in the present embodiment is installed within a pair of corresponding generally cylindrical openings 16*a* and 16*b* formed within the rear flat surface 12*a* of the sacrificial anode 12. Alternatively, the wear indicator 10 may be conical in shape or any other shape which will ensure that the wear indicator 10 will not easily fall out of the sacrificial anode 12 after it is exposed as described below. Alternatively, the wear indicator 10 may be installed within the sacrificial anode 12 when it is molded or cast. It will be appreciated by those of ordinary skill in the art that other techniques maybe employed for inserting the wear indicator 10 into the interior of the sacrificial anode 12 and that the wear indicator 10 may be of some other shape, if desired.

As shown in FIG. 1, the overall length of the wear indicator 10 is such that when installed within the openings 16*a*, 16*b* of the sacrificial anode 12 and when the sacrificial anode 12 is installed on the protected metal 14, the wear indicator 10 is not visible from the exposed exterior of the sacrificial anode 12. In particular, the sacrificial anode 12 when originally produced and installed for use has a radius R1 which, in this embodiment, is approximately twice as long as the overall length of the wear indicator 10 but could be of a greater or lesser length if desired for a particular application. During use, the sacrificial anode 12 corrodes/erodes to the point where the exterior surface of the sacrificial anode 12 eventually reaches a radius R2 and at least a portion of the axial end surface of the wear indicator 10 is exposed for viewing by a user. Once the wear indicator 10 is exposed, approximately one half of the sacrificial anode 12 has corroded and a brightly colored, highly visible generally circular spot formed by the axial end of the wear indicator 10 appears on the surface of the remaining portion of the sacrificial anode 12 telling a user, upon a visual inspection, that the sacrificial anode 10 has reached the end of its useful life and should be replaced.

Figure 2A:
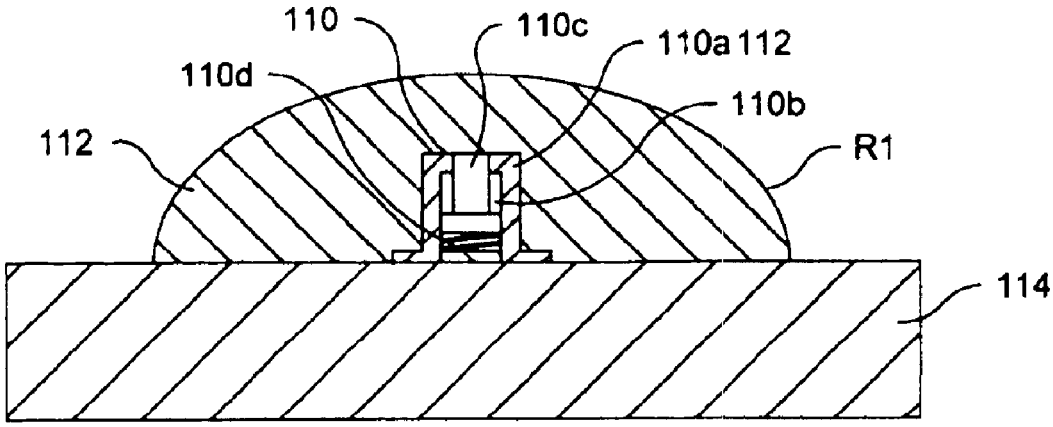
FIGS. 2A and 2B are sectional schematic block diagrams of a sacrificial anode incorporating a visual wear indicator in accordance with a second preferred embodiment of the present invention.
Figure 2B:
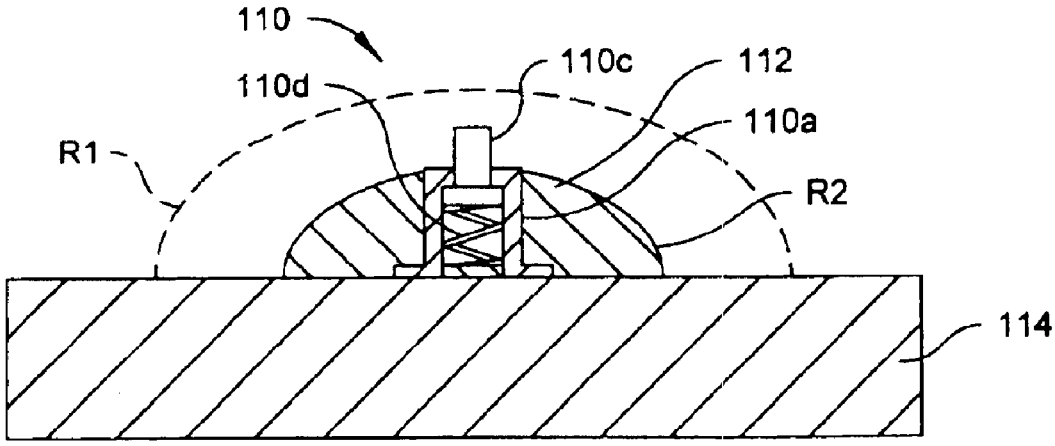

FIGS. 2A and 2B illustrate a second preferred embodiment of a visual wear indicator 110 in accordance with the present invention. FIGS. 2A and 2B are cross-sectional schematic representations of a metal component 114 to be protected and a sacrificial anode 112 substantially the same as the sacrificial anode 12 described above in connection with the first embodiment.

The wear indicator 110, which is formed of a material of the type described above in connection with the first embodiment, is comprised of a generally cylindrical base portion 110*a* which is located or embedded within the interior of the sacrificial anode 112. The cylindrical base 110*a* includes a central bore 110*b* within which is positioned a generally cylindrical pop-up wear indicator button 110*c* and a biasing spring 110*d*. When initially installed within the sacrificial anode the button 110*c* is pushed into the bore 110*b* and is held therein against the bias of the spring 110*d* by the material of the sacrificial anode 112 as shown FIG. 2A. During use, when the sacrificial anode 112 corrodes to about one half of the initial thickness, substantially at the point where the exterior surface of the sacrificial anode 12 reaches a radius R2 the pop-up button 110*c* is exposed and released and is pushed outwardly by the bias of the spring 110*d* to a position extending beyond the remaining surface of the sacrificial anode 112 as shown in FIG. 2B. The pop-up button 110*c* is preferably brightly colored and highly visible to provide an easily observable visual indication to a user that the sacrificial anode 112 has deteriorated to the end of its useful life and that it is time for replacement.

Figure 3A:
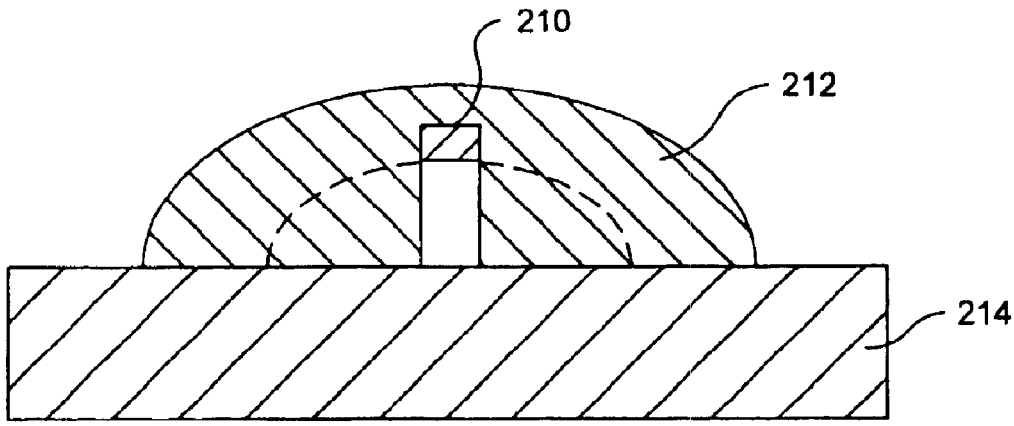
FIGS. 3A and 3B are sectional schematic block diagrams of a sacrificial anode incorporating a wear indicator in accordance with a third preferred embodiment of the present invention.
Figure 3B:
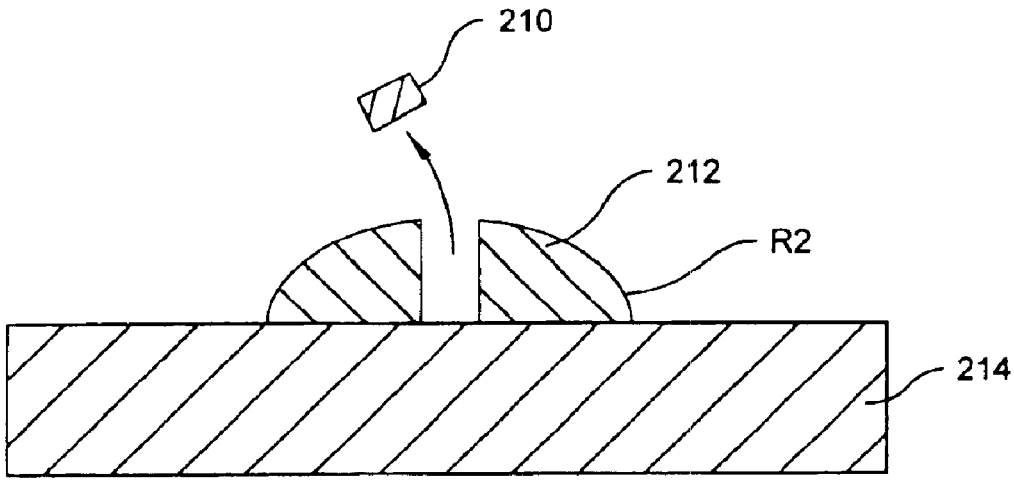

FIGS. 3A and 3B illustrate a third preferred embodiment of a wear indicator 210 in accordance with the present invention. In the embodiment shown in FIGS. 3A and 3B the protected metal component 214 and sacrificial anode 212 are as described above in connection with the first embodiment.

As shown in FIG. 3A, in the present embodiment the wear indicator 210 is formed of a passive or active radio frequency identification (RFID) device in the present embodiment comprising a disposable electronic circuit and antenna which is embedded at a predetermined location within the sacrificial anode 212. RFID devices are well known in the art and are commercially available from many sources. A radio frequency interrogator/reader (not shown) within the facility periodically transmits a radio frequency signal to the RFID device 210 which responds with an encoded radio signal which is detected by the interrogator/reader. As long as the signal from the RFID device 210 is received by the interrogator/reader, the sacrificial anode 212 is serviceable. When the sacrificial anode 212 wears or corrodes to the point where it needs to be replaced, the RFID device 210 is exposed and falls off of the sacrificial anode 212 as shown in FIG. 3B. The interrogator/reader detects the loss of the signal from the RFID device 210 and provides automated notification of the need to replace the sacrificial anode 212.

Figure 4A:
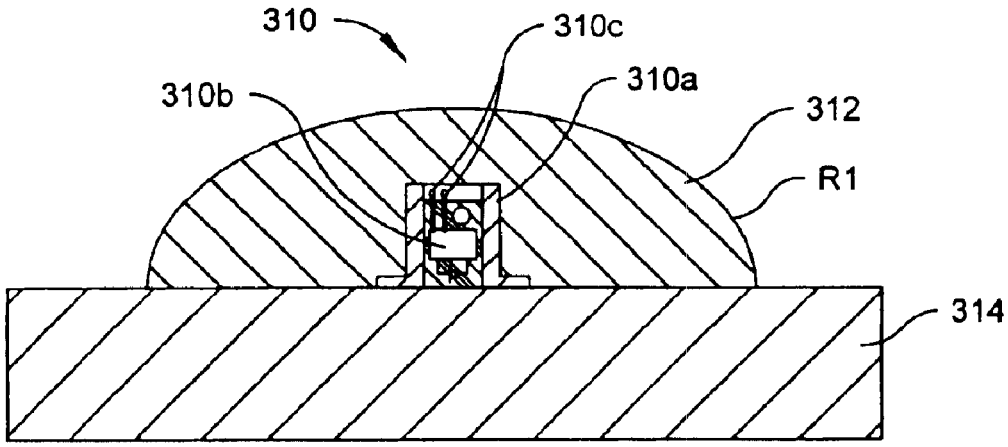
FIGS. 4A and 4B are sectional schematic block diagrams of a sacrificial anode incorporating a wear indicator in accordance with a fourth preferred embodiment of the present invention.
Figure 4B:
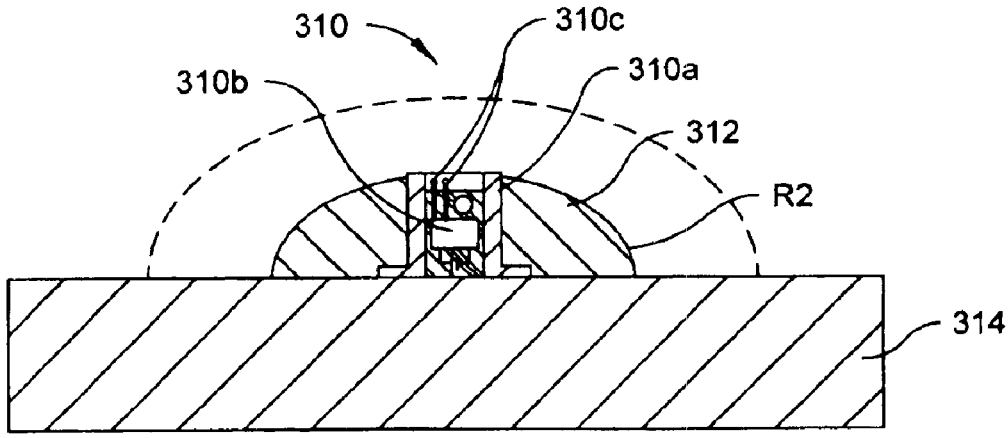

FIGS. 4A and 4B illustrate a fourth preferred embodiment of a wear indicator 310 in accordance with the present invention. The protected metal component 314 and the sacrificial anode 312 are essentially the same as described above in connection with the first preferred embodiment.

The wear indicator 310 in the present embodiment includes a generally cylindrical base portion 310*a* which contains therein an electrically operated monitoring system 310*b*. The electrically operated monitoring system 310*b* includes a power supply, preferably a battery, an electronic indicator system and a pair of spaced, electrical contacts 310*c*. The entire monitoring system 310*b* is embedded within the sacrificial anode 312 and is initially sealed by the anode material from being contacted by water or any other electrolyte. As shown in FIG. 4B, when the sacrificial anode 312 is corroded or worn away to the point when the electrical contacts 310*c* are exposed to the water or other electrolyte, the change in resistance between the contacts 310*c* caused by such exposure is detected by the electronic indicator system which generates an alarm signal. The alarm signal may be in the form of a visual signal such as a light, an audible signal such as a "beep" or some other alarm signal. The alarm signal signifies that the sacrificial anode 312 has reached the end of its useful life and should be replaced.

Figure 5A:
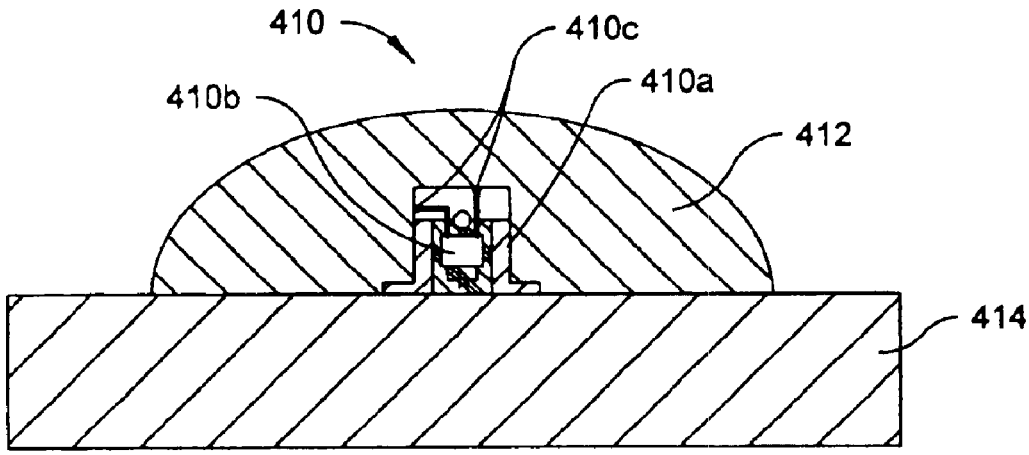
FIGS. 5A and 5B are sectional schematic block diagrams of a sacrificial anode incorporating a wear indicator in accordance with a fifth preferred embodiment of the present invention.
Figure 5B:
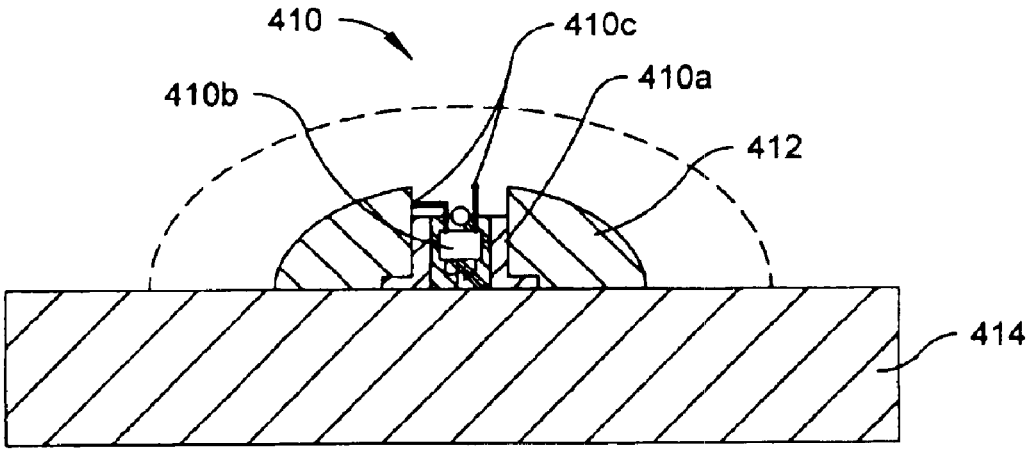

FIGS. 5A and 5B illustrate a fifth preferred embodiment of a wear indicator 410 in accordance with the present invention. Again, the protected metal component 414 and the sacrificial anode 412 are essentially the same as described above in connection with the first embodiment.

The wear indicator 410 in the present embodiment includes a generally cylindrical housing 410*a* within which is positioned an electrical monitoring system 410*b*. The electrical monitoring system 410*b* includes a power supply, preferably a battery, an indicator system and a pair of spaced apart electrical contacts 410*c*. The electrical contacts 410*c* complete an electrical circuit which extends through the sacrificial anode material which is electrically conductive. When the sacrificial anode material corrodes or wears down to the point where one or both of the electrical contacts 410*c* are no longer in electrical contact with the anode material as shown in FIG. 5B, the electrical circuit is broken. The indicator system detects the change in the circuit condition and generates an alarm signal which may be in the form of a light or other visual alarm signal, an audible alarm such as a "beep" or some other type of alarm signal. The alarm signal signifies that the sacrificial anode 412 has reached the end of its useful life and should be replaced.

Figure 6A:
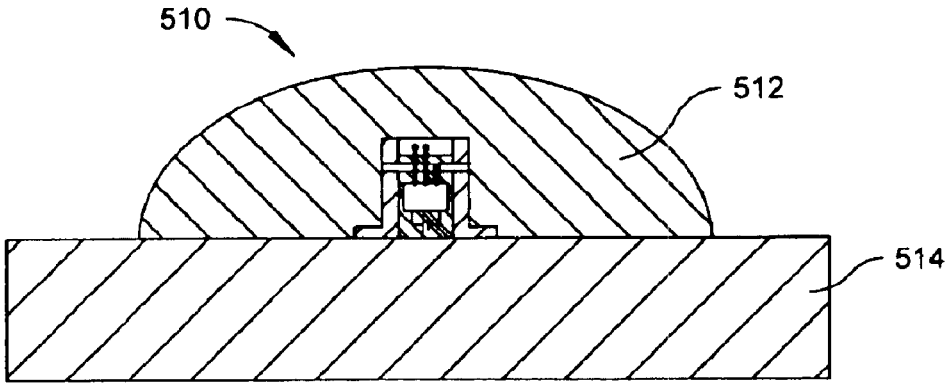
FIGS. 6A, 6B and 6C are sectional schematic block diagrams of a sacrificial anode incorporating a wear indicator in accordance with a sixth preferred embodiment of the present invention.
Figure 6B:
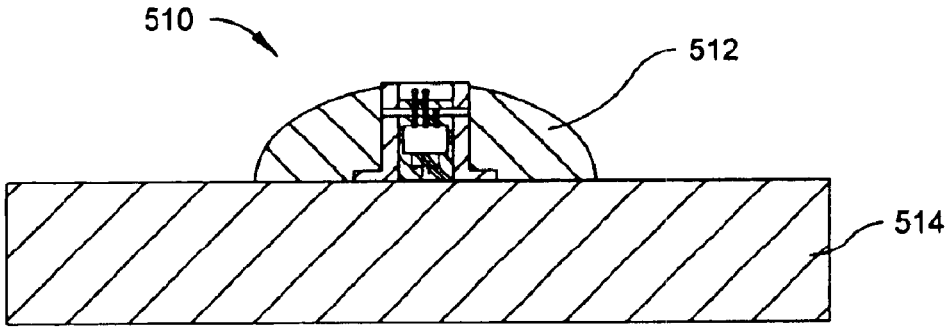
Figure 6C:
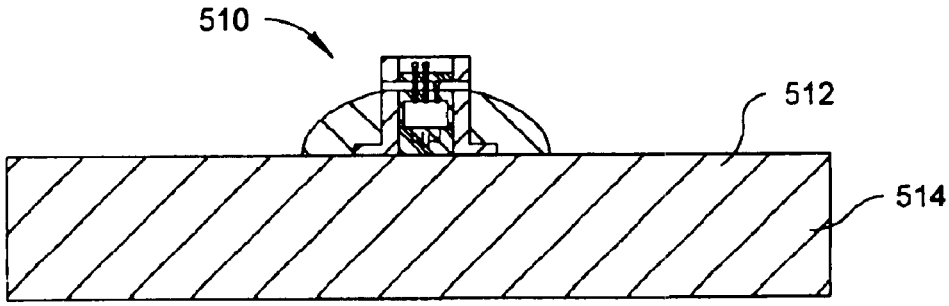

FIGS. 6A, 6*b* and 6C illustrate a sixth preferred embodiment of a wear indicator 510 in accordance with the present invention. As with the prior embodiments, the protected metal component 514 and the sacrificial anode 512 are essentially the same as described in connection with the first preferred embodiment.

As illustrated in FIGS. 6A–6C, the wear indicator 510 in the present embodiment is essentially the same as the wear indicator 410 as described above in connection with FIGS. 4A and 4B and includes an electrically operated monitoring system which includes a power supply, an electronic indicator system and electrical contacts. The monitoring system is embedded within the sacrificial anode 512 so that none of the electrical contacts are initially contacted by water or any other electrolyte. However, in the sixth preferred embodiment, the wear indicator 510 includes three or more spaced contacts which, preferably, are located at different heights or distances within the sacrificial anode 512. As shown in FIGS. 6A–6C, as the sacrificial anode 512 deteriorates, individual electrical contacts are exposed and come into contact with the water or other electrolyte at different extents of sacrificial anode deterioration. The indicator system determines when each contact is exposed to the water or other electrolyte and provides an alarm signal of the type described above. In this manner, a first alarm signal may be generated when the sacrificial anode 512 reaches a first point of deterioration, a second alarm signal may be generated when the sacrificial anode 512 reaches a second point of deterioration, etc. In this manner a user is given several warnings of the need to replace the sacrificial anode 512.

Figure 7:
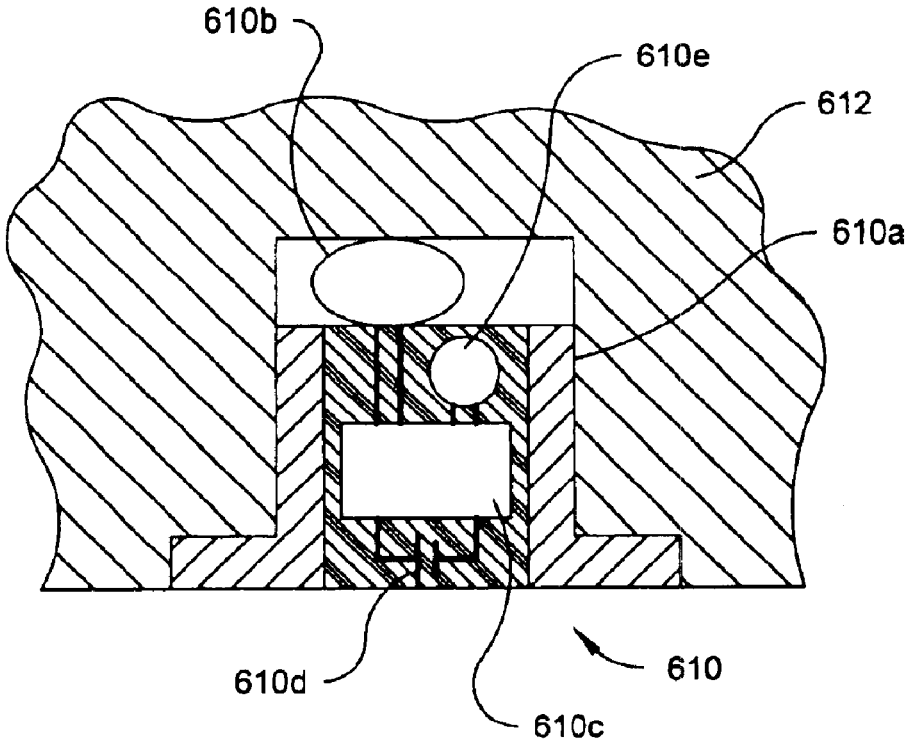
FIG. 7 is a sectional schematic block diagram of a sacrificial anode incorporating a wear indicator in accordance with a seventh preferred embodiment of the present invention.

FIG. 7 illustrates a seventh preferred embodiment of a wear indicator 610 in accordance with the present invention. The protected metal component (not shown) and the sacrificial anode 612 are essentially the same as described above in connection with the first embodiment.

In the present embodiment, the wear indicator 610 is comprised of a generally cylindrical housing 610*a* embedded within the sacrificial anode 612 and containing a detection system or detector 610*b*, a monitoring system 610*c* a power supply or battery 610*d* and an indicating system or indicator 610*e*. The indicator 610*e*, which generates an alarm, could comprise a light emitting diode (LED) or other visual alarm which could flash to conserve power. The indicator 610*e* could also provide an audible alarm or could be associated with an automatic identification system including a separate interrogator/reader at a remote location to generate an alarm. The detection system 610*b* includes a sensor such as electrical contacts, or other device for sensing the presence or absence of the sacrificial anode 612 and for generating a detection signal. The monitoring system 610*c* is in communication with the detection system 610*b* and receives and decodes detection signals received from the detection system 610*b* and provides an indicator signal to the indicator 610*e* when the sacrificial anode 612 deteriorates to the point where it should be replaced and notification is desirable. The indicator 610*e* receives the indicator signal from the monitoring system 610*c* and provides the visual, audio or other indicator or alarm.

Figure 8:
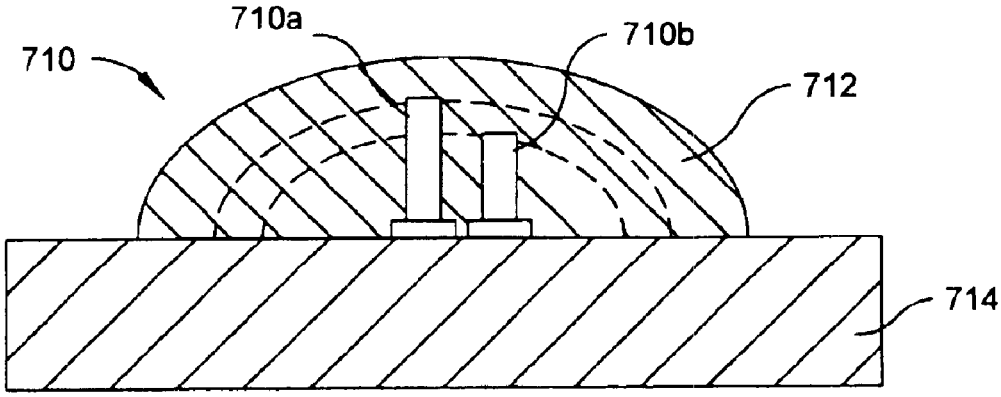
FIG. 8 is a sectional schematic block diagram of a sacrificial anode incorporating a wear indicator in accordance with an eighth preferred embodiment of the present invention

FIG. 8 illustrates an eighth preferred embodiment of a wear indicator 710 in accordance with the present invention. The protected metal component 714 and the sacrificial anode 712 are essentially the same as described above. The embodiment shown in FIG. 8 is essentially the same as the embodiment shown in FIG. 1. However, in the embodiment shown in FIG. 8 there are two separate wear indicators 710*a* and 710*b*. Both wear indicators are structurally the same as the wear indicator 10 described above in connection with the first embodiment. However, in the present embodiment, wear indicator 710*a* is at least slightly longer than wear indicator 710*b* and preferably is of a different color. For example, in the illustrated embodiment, wear indicator 710*a* is orange, whereas wear indicator 710*b* is red. Because wear indicator 710*a* is slightly longer than wear indicator 710*b*, wear indicator 710*a* will be exposed first providing a preliminary warning that the sacrificial anode 712 has deteriorated to the point where a replacement would soon be required. Like the first preferred embodiment, wear indicator 710*b* will be exposed when the deterioration of the sacrificial anode 712 reaches the point where replacement is needed.

From the foregoing, it can be seen that the present invention comprises a wear indication for indicating when a sacrificial anode has corroded to the point where it should be replaced. It will be appreciated by those skilled in the art that changes could be made to the embodiments described above without departing from the broad inventive concepts thereof.

It is understood, therefore, that this invention is not limited to the particular embodiments disclosed, but it is intended to cover all modifications within the spirit and scope of the invention as defined by the appended claims.

We claim:

1. An apparatus for visually indicating when a predetermined portion of a sacrificial anode has been corroded, the apparatus comprising a first non-corroding wear indicator embedded within the interior of the sacrificial anode at at least a first predetermined distance from an exposed exterior surface of the sacrificial anode so that the wear indicator is not visible when the sacrificial anode is initially installed on a metal to be protected, the wear indicator becoming exposed and visible only after at least the predetermined portion of the sacrificial anode has corroded.

2. The apparatus as recited in claim 1, wherein the sacrificial anode is generally semi-circular in cross section with an initial radius R1 and the wear indicator is located at a radius R2 where the difference between radius R1 and radius R2 is the predetermined distance.

3. The apparatus as recited in claim 2, wherein the radius R2 is approximately one-half of the radius R1.

4. The apparatus as recited in claim 1, wherein the wear indicator is made of a polymeric material.

5. The apparatus as recited in claim 1, wherein the wear indicator is a bright, easily visible color.

6. The apparatus as recited in claim 1, wherein the wear indicator is generally cylindrical so that when the predetermined portion of the sacrificial anode has corroded an axial end surface of the wear indicator is exposed and visible as a generally circular spot.

7. The apparatus as recited in claim 1, wherein the wear indicator comprises a button which is biased to pop up beyond the surface of the sacrificial anode when the predetermined portion of the sacrificial anode has corroded.

8. The apparatus as recited in claim 7, wherein the button is brightly colored and highly visible when popped up.

9. The apparatus as recited in claim 1, further including a second non-corroding wear indicator embedded within the interior of the sacrificial anode at a second predetermined distance from the exposed exterior surface of the sacrificial anode, the second predetermined distance being less than the first predetermined distance so that the second wear indicator becomes exposed and visible after the sacrificial anode has corroded to the extent of the second predetermined distance.

10. The apparatus as recited in claim 9, wherein the first and second wear indicators are different colors.

11. An apparatus for indicating when a predetermined portion of a sacrificial anode has been corroded, the apparatus comprising:

a detector embedded within the interior of the sacrificial anode initially at a predetermined distance from an exposed exterior surface of the sacrificial anode, the detector for detecting the absence of sacrificial anode material when the predetermined portion has corroded and for generating a detection signal;

a monitoring system in communication with the detector for receiving detection signals and for generating an indicator signal when a detection signal is received; and an indicator in communication with the monitoring system for receiving indicator signals and for generating an alarm when an indicator signal is received.

12. The apparatus as recited in claim 11, further including a housing embedded within the sacrificial anode for containing the detector, the monitoring system and the indicator.

13. The apparatus as recited in claim 11, wherein the detector comprises a pair of spaced electrical contacts which are initially not electrically connected to each other, the corrosion of the predetermined portion of the sacrificial anode resulting in both contacts being exposed to an electrolyte to electrically connect the contacts and generate a detection signal.

14. The apparatus as recited in claim 11, wherein the detector comprises a pair of spaced electrical contacts which both initially engage the sacrificial anode so that the contacts are initially electrically connected to each other, the corrosion of the predetermined portion of the sacrificial anode resulting in the electrical connection between the contacts being broken to generate a detection signal.

15. The apparatus as recited in claim 11, wherein the alarm is an audible alarm.

16. The apparatus as recited in claim 11, wherein the alarm is a visible alarm.

17. The apparatus as recited in claim 13, wherein the electrical contacts are initially both at the same distance from the exposed surface of the sacrificial anode.

18. The apparatus as recited in claim 17, further including a third electrical contact embedded within the sacrificial anode at a distance which is different from the predetermined distance.

19. An apparatus for indicating when a predetermined portion of a sacrificial anode has been corroded, the apparatus comprising a radio frequency identification (RFID) device embedded within the interior of the sacrificial anode at a predetermined distance from an exposed exterior surface of the sacrificial anode, the presence of the RFID device being detectable by a detection system until the predetermined portion of the sacrificial anode has corroded, whereupon the RFID device separates from the sacrificial anode and is no longer detectable.

* * * * *